United States Patent [19]

Fasnacht, Jr.

[11] 4,100,888

[45] Jul. 18, 1978

[54] VAPOR GENERATOR STEAM DRUM SPRAY HEAD

[75] Inventor: Floyd A. Fasnacht, Jr., Massillon, Ohio

[73] Assignee: The United States of America as represented by the United States Department of Energy, Washington, D.C.

[21] Appl. No.: 667,053

[22] Filed: Mar. 15, 1976

[51] Int. Cl.[2] ..... F22D 11/00

[52] U.S. Cl. ..... 122/438; 122/34

[58] Field of Search ..... 122/32, 33, 34, 438, 122/491

[56] References Cited

U.S. PATENT DOCUMENTS

| | | | |
|---|---|---|---|
| 188,201 | 3/1877 | Snowdon | 122/438 |
| 2,862,479 | 12/1958 | Blaser, et al. | 122/34 |
| 3,114,353 | 12/1963 | Sprague | 122/34 |
| 3,298,358 | 1/1967 | Alden, Jr. | 122/34 |
| 3,661,123 | 5/1972 | Romanos | 122/438 |

*Primary Examiner*—Kenneth W. Sprague

*Attorney, Agent, or Firm*—Dean E. Carlson; R. G. Erdley; J. M. Maguire

[57] ABSTRACT

A typical embodiment of the invention provides a combination feedwater and "cooldown" water spray head that is centrally disposed in the lower portion of a nuclear power plant steam drum. This structure not only discharges the feedwater in the hottest part of the steam drum, but also increases the time required for the feedwater to reach the steam drum shell, thereby further increasing the feedwater temperature before it contacts the shell surface, thus reducing thermal shock to the steam drum structure.

2 Claims, 2 Drawing Figures

VAPOR GENERATOR STEAM DRUM SPRAY HEAD

BACKGROUND OF THE INVENTION

1. Field of the Invention

This invention relates to power generation systems and, more particularly, to feedwater and cooldown water discharge apparatus for use in nuclear power system steam drums, and the like.

2. Description of the Prior Art

In nuclear power plants, as well as in other steam generation systems, it is usually necessary to separate moisture from the steam that is generated within the system in order to produce the "dry" steam needed to drive the turbines and other plant machinery. This separation usually is carried out in the steam drum which encloses an array of devices that are frequently referred to as "steam separators".

In certain types of nuclear reactor systems, for example, the steam drum is mounted directly above and in fluid communication with a heat exchanger. In this arrangement, the water in the heat exchanger absorbs heat from the primary reactor coolant. The water then rises into steam that flows upwardly through the heat exchanger and into the steam drum for moisture separation. For a number of reasons, the feedwater is introduced into the system by means of a tubular ring that is positioned in the transition between the heat exchanger and the steam drum. This ring has a number of holes and is spaced inwardly of the walls of the transition in order to discharge the feedwater through the holes and into an annular chamber that encloses the steam generating section of the heat exchanger.

This particular feature of prior steam drums has been a source of difficulty. In this respect, the cold feedwater striking the relatively thick, hot steel pressure vessel, or shell, that encloses the heat exchanger frequently produces undesirable and potentially destructive stresses. The tubular ring also presents a number of problems. Thus, for a marine or shipboard installation the ring arrangement is quite unsatisfactory during rolling or listing conditions. The ring also must be mounted securely within the transition. In spite of this obvious need for a secure mounting, the ring nevertheless must be able to respond to thermal expansion and contraction without bulging or becoming permanently deformed. Because this ring is mounted in the transistion between the heat exchanger and the steam drum, the ring tends to obstruct the flow of steam and moisture into some of the separators in the steam drum.

There is a further need to provide an emergency spray of cooling water for the heat exchanger in the event a leak occurs and feedwater is lost. This emergency spray should remove residual heat from the heat exchanger and prevent thermal damage to the heat exchanger structure. Ordinarily, provision is made for introducing this "cooldown" spray through a conduit that penetrates the transition wall. The conduit terminates at the longitudinal axis of the heat exchanger in a 90° bend with an attached spray head. The spray head directs the cooldown fluid into the central portion of the heat exchanger in the event of a loss of coolant accident. Thus, there usually are two means for supplying the heat exchanger with fluids, the cooldown conduit and the feedwater ring, the ring, moreover, presenting a number of difficult problems. Accordingly, there is a need to improve fluid delivery systems for heat exchangers.

SUMMARY OF THE INVENTION

These and other difficulties that have characterized the prior art are overcome, to a large extent, through the practice of the invention. Typically, a centrally disposed spray head is positioned in the lower portion of the steam drum and in alignment with the drum's longitudinal axis. The spray head has an interior partition that separates the perforated upper portion of the head from the perforated lower head portion. A feedwater inlet conduit penetrates the spray head and establishes fluid communication with the perforated upper portion, and a cooldown fluid conduit provides a path for fluid communication out through the perforations in the lower head portion.

This physical arrangement is more compact in that it eliminates the difficult-to-design and inconvenient tubular feedwater ring. There is, however, a more subtle and significant advantage in the structure that characterizes the invention. In this respect, the centrally positioned feedwater discharge on the spray head is located in one of the hottest portions of the heat-exchanger-steam drum combination. Further in this respect, the spray head is spaced as far from the inside surface of the steam drum wall as possible. This specific combination of feedwater discharge in one of the hottest portions of the system and increased distance for the discharged feedwater to travel from the spray head until it contacts the inner surface of the steam drum wall preheats the feedwater and increases the feedwater temperature before that contact, thereby alleviating thermal stresses in the pressure vessel from which the steam drum is formed. The elimination of the tubular feedwater ring also removes an obstruction from the lower portion of the steam drum and, in this manner, provides more area for feeding the steam and moisture mixture into the steam separators. This feature of the improved structure also produces a more efficient flow into the steam separators.

The combined cooldown fluid spray head further advances the compact nature of the invention because it is located immediately below the feedwater discharge.

The various features of novelty which characterize the invention are pointed out with particularity in the claims annexed to and forming a part of this specification. For a better understanding of the invention, its operating advantages and specific objects attained by its use, reference should be had to the accompanying drawing and descriptive matter in which there is illustrated and described a preferred embodiment of the invention.

DETAILED DESCRIPTION OF THE PREFERRED EMBODIMENTS

Figure 1:
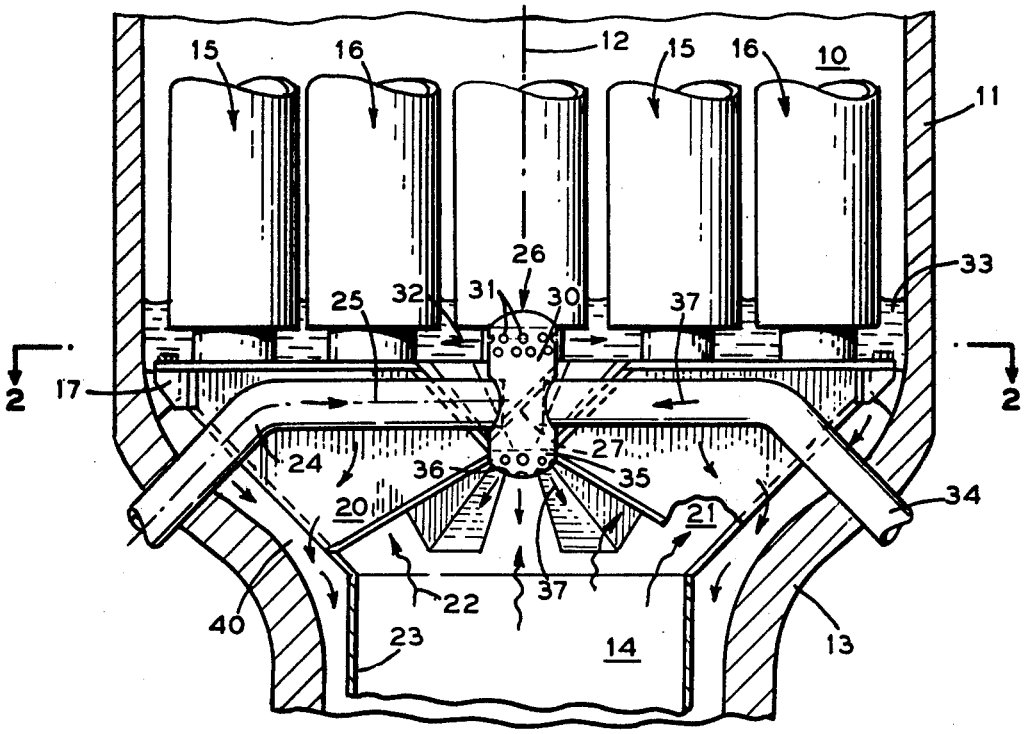
FIG. 1 is a front elevation in full section of a typical embodiment of the invention.

For a more complete appreciation of the invention, attention is invited to FIG. 1 which shows a generally vertical, cylindrical steam drum 10 that has a thick metal wall 11 which is concentric with a longitudinal center line 12. The lower portion of the steam drum terminates in an inwardly curved transition 13, also circular in transverse cross section, that matches the larger diameter of the steam drum 10 to the smaller diameter of a heat exchanger 14.

Figure 2:
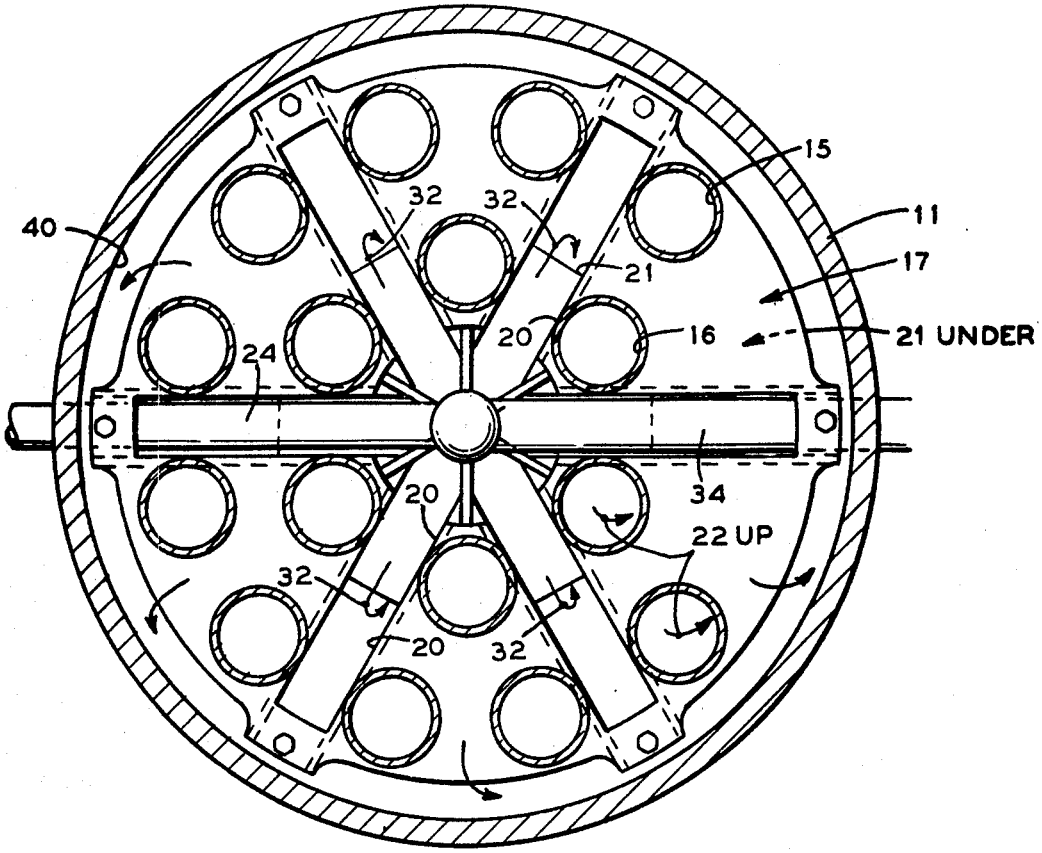
FIG. 2 is a plan view of the apparatus shown in FIG. 1, taken along the lines 2—2 of FIG. 1, looking in the direction of the arrows.

Within the steam drum 10, two concentric, circular arrays of vertically mounted steam separators 15, 16 (FIG. 2) are spaced inward of the metal wall 11 that forms the pressure vessel for the drum. As shown in FIG. 1, the steam separator arrays 15, 16 are secured to a support assembly 17. As shown in FIG. 2 of the drawing, the support assembly 17 also provide compartment 21 that channels the steam and moisture mixture generated in the heat exchanger 14 (FIG. 1) into the steam separators 15, 16 in the direction indicated by means of arrows 22. In addition ducts 20 provides a channel for feedwater distribution from the center to the downcomer 40.

Thus, in accordance with the invention and as best illustrated in FIG. 1, a feedwater inlet pipe 24 penetrates the metal wall 11 that forms a portion of the transition 13 between the steam drum 10 and the heat exchanger 14. The inlet pipe 24 enters the interior of the transition 13 at an acute angle with respect to the center line 12 of the steam drum 10. Within the transition 13, the feedwater inlet pipe 24 is bent through an angle that is sufficient to enable an extension of the pipe's center line 25 to intersect perpendicularly the center line 12 of the steam drum 10, in that portion of the steam drum that is below the support assembly 17 for the steam separator arrays 15, 16.

The feedwater inlet pipe 24 establishes fluid communication with a portion of the interior of a hollow, generally cylindrical spray head 26. The longitudinal axis of the cylindrical portion of the spray head 26 coincides with the center line 12 of the steam drum 10, the pipe mating with the spray head 26 through a slip joint to provide for relative movement in response to thermal expansion and contraction.

Within the spray head 26, a water tight diaphragm 27 generally divides the interior volume of the spray head into two approximately equal portions. As shown in FIG. 1 of the drawing, the diaphragm 27 is disposed at an acute angle relative to the steam drum center line 12 to insure that all of the feedwater discharge from the inlet pipe 24 that flows into the interior of the spray head 26 also flows only through upper portion 30 and out into the interior of the steam drum 10 by way of an array of perforations 31 that are formed near the top edge of the vertical cylindrical surface of the spray head.

This arrangement of the perforations 31 compels the incoming feedwater to flow in the direction of arrows 32 in a generally radial direction toward the surrounding metal wall 11 of the steam drum 10. Because the temperature of the steam-moisture mixture within the steam drum 10 often is at a maximum at this point, the difference in temperatures between the incoming feedwater and the steam-moisture mixture 33 within the drum 10 is at its greatest, thereby enabling the temperature of the discharged feedwater to increase to the greatest possible extent within the physical confines of the system under consideration before contacting the metal wall 11 of the steam drum. The central axis disposition of the spray head 26, moreover, maximizes the time required for a given volume of discharged feedwater to flow through the radial distance from the spray head 26 to the steam drum wall 11. This is due to the fact that the distance between the point of feedwater discharge and the wall 11 is greatest in the steam drum arrangement that characterizes the invention.

The net effect of this greater travel time and increased temperature difference for the feedwater is to significantly raise the temperature of the discharged feedwater and thereby to alleviate potentially damaging thermal shock or thermal stress that usually occurred when relatively cold feedwater contacted the hotter steam drum walls.

It will be recalled that a "cooldown" spray is required to control the temperatures within the heat exchanger 14 in the event that the normal working fluid within the heat exchanger is lost through a leak, a broken conduit, or the like. Toward this end, and in accordance with another salient feature of the invention, a cooldown inlet pipe 34 establishes fluid communication between the fluid system that provides the loss of coolant spray liquid (not shown) and lower spray head portion 35. The cooldown pipe 34 penetrates the metal wall 11 that forms a portion of the transistion 13 between the steam drum 10 and the heat exchanger 14. The cooldown pipe 34 enters the interior of the transition 13 at an acute angle with respect to the center line 12 of the steam drum 10. Within the transition 13 the cooldown pipe 34 is bent through an angle that is sufficient to enable an extension of the pipe's center line to intersect perpendicularly the center line 12 of the steam drum 10, in that portion of the steam drum that is below the support assembly 17 for the steam separator arrays 15, 16.

The cooldown pipe 34, moreover, enters the lower portion 35 of the spray head 26 through a slip joint to provide an allowance for thermal expansion and contraction. An arcuate and perforated lower transverse sprayer plate 36 distributes a cooldown spray within the heat exchanger shroud 23 whenever the cooldown system is activated to enable fluid to flow in the direction of arrows 37 through the pipe 34, the lower spray head portion 35 and the sprayer plate 36 to the heat exchanger 14.

In operation, feedwater is discharged within the steam drum 10 by way of a path that includes the feedwater inlet pipe 24, the spray head upper portion 30 and the perforations 31 in the longitudinal cylindrical wall of the spray head 26. Because the temperature of the steam-moisture mixture 33 is at a maximum in this axial central discharge location, the discharged feedwater undergoes a swift increase in temperature and has a greater time available to reach this temperature before contacting the heat exchanger wall 11. As hereinbefore mentioned, this further increase in discharged feedwater temperature provides a significant decrease in the danger of thermal shock to the steam drum structure. As best shown in FIG. 2, the radially disposed feedwater inlet pipe 24 further is nested between adjacent sets of the steam separators 15, 16. This feature of the invention prevents the feedwater pipe from blocking the inlets to a number of the steam separators or obstructing fluid downcomer passageway 40. The location of the spray head 26 also provides a sturdier and more satisfactory arrangement for a marine installation which must be able to withstand rolling, listing and other motions and vibrations that are experienced during operation at sea.

The diaphragm 27 which divides the spray head 26 into upper and lower portions 30 and 35, moreover, permits the centrally disposed cooldown spray head to combine with the function of feedwater inlet in a manner that overcomes a number of inadequacies in the prior art.

The embodiments of the invention in which an exclusive property or privilege is claimed are defined as follows:

1. Apparatus for supplying feedwater and cooldown fluid to a steam drum comprising a wall that establishes a longitudinal center line within the steam drum, a feedwater spray head disposed within the steam drum having a longitudinal center line that is generally in alignment and coincident with said steam drum center line, said spray head having at least one feedwater discharge perforation formed in the surface thereof, a feedwater inlet pipe penetrating said surface to establish fluid communication with said spray head to enable feedwater to flow from said feedwater inlet pipe through said spray head and out through said perforation into said steam drum, a water tight diaphragm positioned within said spray head in order to divide the interior volume of said spray head into at least two portions, one of said two portions providing said fluid communication between said feedwater inlet pipe and said feedwater discharge perforation and the other portion of said two portions accommodating the cooldown fluid to control temperature within the steam drum.

2. Apparatus for supplying feedwater to a steam drum comprising a wall that establishes a longitudinal center line within the steam drum, a feedwater spray head disposed within the steam drum having a longitudinal center line that is generally in alignment with said steam drum center line, said spray head having at least one feedwater discharge perforation formed in the surface thereof, a feedwater inlet pipe penetrating said wall to establish fluid communication with said spray head to enable feedwater to flow from said feedwater inlet pipe through said spray head and out through said perforation into the steam drum, a diaphragm positioned within said spray head in order to divide said spray head into at least two portions, one of said two portions providing said fluid communication between said feedwater inlet pipe and said feedwater discharge perforation, a cooldown inlet pipe penetrating said steam drum wall in order to establish cooldown fluid communication with the other of said two spray heat portions, and a sprayer plate formed in said other spray head portion and having at least one cooldown perforation formed therein to discharge the cooldown fluid from said spray head.

* * * * *